US005669225A

United States Patent [19]

Beaverson et al.

[11] Patent Number: 5,669,225

[45] Date of Patent: Sep. 23, 1997

[54] VARIABLE SPEED CONTROL OF A CENTRIFUGAL CHILLER USING FUZZY LOGIC

[75] Inventors: Gregory K. Beaverson, York; Russell P. Wueschinski, Dover; Craig N. Shores, York; John C. Hansen, Spring Grove, all of Pa.

[73] Assignee: York International Corporation, York, Pa.

[21] Appl. No.: 671,481

[22] Filed: Jun. 27, 1996

[51] Int. Cl.[6] ..... F25D 17/02; F04B 49/00

[52] U.S. Cl. ..... 62/201; 62/228.4; 236/78 D; 417/42

[58] Field of Search ..... 62/228.4, 209, 62/201; 417/42; 236/78 D

[56] References Cited

U.S. PATENT DOCUMENTS

| | | | |
|---|---|---|---|
| 4,151,725 | 5/1979 | Kountz et al. | 62/182 |
| 4,608,833 | 9/1986 | Kountz | 62/228.1 |
| 4,726,738 | 2/1988 | Nakamura et al. | 417/42 X |
| 5,158,024 | 10/1992 | Tanaka et al. | 110/186 |
| 5,259,210 | 11/1993 | Ohya et al. | 62/212 |
| 5,272,428 | 12/1993 | Spiegel et al. | 318/803 |
| 5,355,691 | 10/1994 | Sullivan et al. | 62/201 |
| 5,372,015 | 12/1994 | Suzuki et al. | 62/228.4 |
| 5,419,146 | 5/1995 | Sibik et al. | 236/78 D X |
| 5,427,313 | 6/1995 | Davis, Jr. et al. | 236/49.3 |
| 5,440,891 | 8/1995 | Hindmon et al. | 62/228.3 X |
| 5,442,926 | 8/1995 | Kawai et al. | 62/211 |
| 5,457,963 | 10/1995 | Cahill-O'Brien et al. | 62/179 X |

FOREIGN PATENT DOCUMENTS

| | | |
|---|---|---|
| 4-260755 | 9/1992 | Japan . |
| 4-297761 | 10/1992 | Japan . |
| 5-52433 | 3/1993 | Japan . |
| 6-185786 | 7/1994 | Japan . |

*Primary Examiner*—William E. Wayner

*Attorney, Agent, or Firm*—Finnegan, Henderson, Farabow, Garrett & Dunner, L.L.P.

[57] ABSTRACT

To capacity control a refrigeration system including a compressor, a condenser, and an evaporator all connected in a closed refrigeration circuit, the compressor having a plurality of adjustable inlet guide vanes and driven by an internal combustion engine, signals indicating the condenser pressure; the evaporator pressure; the inlet guide vanes position; the engine speed; the chilled water discharge temperature; and the engine intake manifold pressure are processed by a microprocessor to continuously calculate a surface speed and to equalize engine speed and calculated surface speed utilizing a fuzzy logic algorithm.

14 Claims, 8 Drawing Sheets

START
76
78
CYCLE_TMR = 0
NO
RETURN
YES
80
CYCLE_TMR = CYCLE_PERIOD; ERROR = (SURFACE_SP + SURGE_MARGIN) - FB_MACH_SP
84
82
RATE_RESET = TRUE
YES
ERROR_PREV = ERROR; RATE_RESET = FALSE
NO
86
RATE=ERROR - ERROR_PREV; ERROR = ERROR_PREV
88
90
-4 <= ERROR <= 4
YES
ERROR = 0
NO
ERROR < -20
YES
ERROR_NEG = 100; ERROR_ZER = 0; ERROR_POS = 0
92
94
A
B

D
142
DECR_SP < TEMP
YES
144
DECR_SP = TEMP
NO
146
RATE_ZER <= ERROR_POS
YES
148
INCR_SP = RATE_ZER
NO
150
INCR_SP = ERROR_POS
152
RATE_POS <= ERROR_ZER
YES
154
TEMP = RATE_POS
NO
156
TEMP = ERROR_ZER
158
INCR_SP < TEMP
YES
160
INCR_SP = TEMP
NO
162
RATE_POS <= ERROR_POS
YES
164
TEMP=RATE_POS
E
F

VARIABLE SPEED CONTROL OF A CENTRIFUGAL CHILLER USING FUZZY LOGIC

BACKGROUND OF THE INVENTION

A. Field of the Invention

The present invention relates generally to motor controls for refrigeration systems. More particularly, the present invention relates to a capacity control system for centrifugal compressor-based water chillers, wherein the speed of an internal combustion engine-driven centrifugal compressor is automatically regulated in response to a continuously updated surface speed using a fuzzy logic software routine to achieve minimum overall chiller energy consumption.

B. Description of the Prior Art

As is generally known, operation of a chiller having a centrifugal compressor driven by an internal combustion engine is most efficient when the compressor speed is minimized and the pre-rotation vane openings are maximized. However, these optimum conditions must be accomplished without surging the compressor or overloading the engine.

Surge or surging is an unstable condition that may occur when compressors, such as centrifugal compressors, are operated at light loads and high pressure ratios. It is a transient phenomenon characterized by oscillations in pressure and flow, and, in some cases, the occurrence of a complete flow reversal through the compressor. Such surging, if uncontrolled, causes excessive vibration in both the rotating and stationary components of the compressor and may result in permanent compressor damage. In particular, at surge conditions there exists a momentary reduction in flow and pressure developed across the compressor. This causes a reduction in the net torque and mechanical power loading at the compressor input shaft. In the case where the drive source is an electric motor, these oscillations in torque and power will cause oscillations in motor current and excessive electrical power consumption.

As is also generally known, engine overload occurs when the torque required from the engine is greater than the torque limit set by the engine designers for a particular RPM. For example, engine overload can occur in a chiller system by a pre-rotation vane failing to close or failure of a feedback signal being provided to a chiller control circuit.

An objective, from the standpoint of maximizing efficiency, is to operate the chiller at the lowest, surge-free, compressor speed possible, but still supply the load and head requirements needed for a particular application.

In certain prior art capacity control systems, approximations of chiller surge surfaces are factory set by means of pre-stored surge surface equations contained in a capacity control unit. In other prior art capacity control systems, approximations of chiller surge surfaces are calculated using hardware and straight-line approximation. The difference between the optimum speed of the compressor drive motor, i.e., the minimum speed at which the compressor is surge free, and the actual motor speed provides a quantity known as the speed error. Speed error is eliminated by incrementally decreasing the compressor speed until the speed error approaches zero, i.e., the actual motor speed equals the optimum surface speed. Thus, the most efficient operating point of the compressor may be achieved. However, such systems use hardware, which only provide approximations, resulting in excessive delay in reaching the optimum operating point.

It is therefore desirable to provide a capacity control system for centrifugal compressor-based water chillers, wherein the speed of a prime mover-driven centrifugal compressor is automatically regulated in response to a continuously updated surface speed using software and a fuzzy logic routine, so as to achieve minimum overall chiller energy consumption, i.e., maximum operating efficiency.

SUMMARY OF THE INVENTION

Accordingly, it is a general object of the present invention to provide a capacity control system for a refrigeration system, wherein prime mover speed is adjusted automatically in response to a continuously updated surface speed so as to realize minimum overall chiller energy consumption.

It is another object of the present invention to provide a capacity control system for a refrigeration system, which includes a microprocessor for calculating the surface speed of the engine from continuous measurements of a PRV position signal, condenser, evaporator and intake manifold pressure signals, and an engine speed signal, and for setting the engine speed at a safety margin from the calculated surface speed.

It is still another object of the present invention to provide a capacity control system for a refrigeration system which includes a microprocessor for calculating the surface speed of the engine from continual measurements of a PRV position signal, condenser, evaporator and intake manifold pressure signals, and an engine speed signal, for calculating the engine speed error by subtracting the engine speed signal from the surface speed, and for driving the engine speed error to zero by using a fuzzy logic software routine contained within a microprocessor of the control panel.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a capacity control system for a refrigeration system including a compressor, a condenser, and an evaporator all connected in a closed refrigeration circuit, the compressor having a plurality of adjustable inlet guide vanes and a prime mover connected to drive the compressor. The control system comprises a first transducer for sensing condenser pressure to generate a first signal; a second transducer for sensing evaporator pressure to generate a second signal; a third transducer for sensing the position of the inlet guide vanes to generate a third signal; a fourth transducer for sensing the actual speed of the engine to generate a fourth signal; a fifth transducer for sensing the temperature of chilled water discharged from the evaporator to generate a fifth signal; a sixth transducer for sensing the load of the prime mover to generate a sixth signal; and a microprocessor responsive to said first through sixth signals for continuously calculating a surface speed of the compressor, and for controlling actual engine drive speed to equal a calculated compressor surface speed utilizing a fuzzy logic algorithm, wherein the prime mover comprises one of an internal combustion engine, an electric motor, and a steam turbine.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings:

FIG. 3(*b*) is a graph showing the fuzzy logic algorithm membership function for the speed rate input;

DESCRIPTION OF THE PREFERRED EMBODIMENTS

The present invention was developed as a control for a refrigeration system driven by a prime mover. It will be appreciated that the present invention has other applications since the invention pertains to a capacity control system and method for automatically regulating the speed of a prime mover using software and a fuzzy logic routine.

Reference will now be made in detail to the presently preferred embodiment of the invention, an example of which is illustrated in the accompanying drawings. Wherever possible, the same reference numbers will be used throughout the figures of the drawings to refer to the same or like parts.

Figure 1:
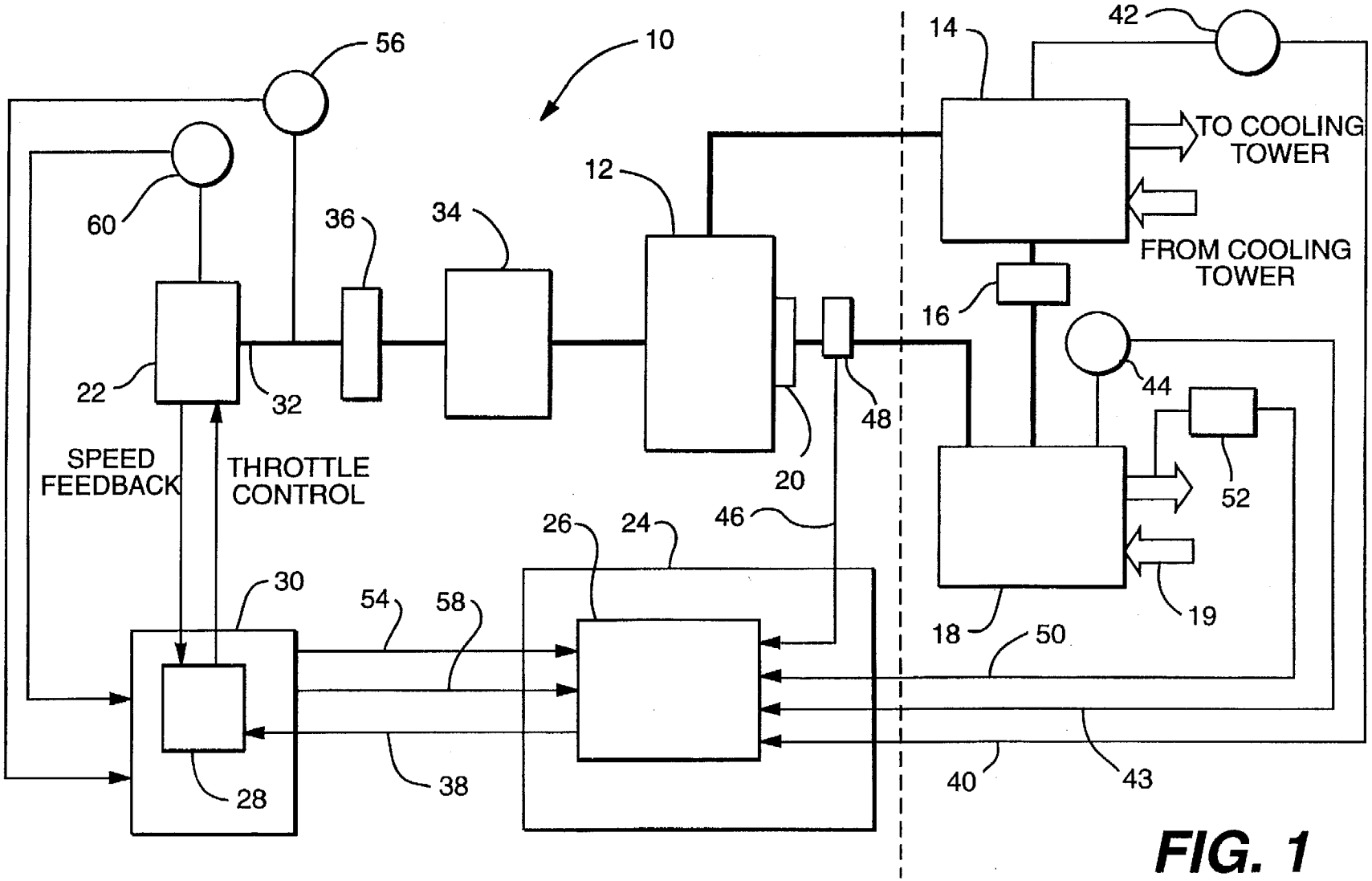
FIG. 1 is a block diagram of a capacity control system in accordance with a preferred embodiment of the present invention, as utilized in a typical refrigeration system.

The capacity control system of the present invention, generally indicated at 10, is depicted in FIG. 1 in its application to a refrigeration system. The refrigeration system includes a centrifugal compressor 12, a condenser 14, an expansion chamber 16 and an evaporator 18, all interconnected in a conventional closed refrigeration circuit. Refrigerant is compressed in compressor 12 and delivered to condenser 14 where it is exposed to a cooling medium, such as water from a cooling tower (not shown), and condensed to a liquid refrigerant. The liquid refrigerant expands as it passes through expansion chamber 16 en route to evaporator 18. As the liquid refrigerant flows through evaporator 18, circulating water from a building's air conditioning equipment enters via conduit 19 into heat exchange relationship with the refrigerant, which is vaporized and returned to a suction inlet of the compressor. In this manner, water is chilled in evaporator 18 for circulation through air cooling units throughout a building. In order to vary the mount of building cooling in response to changes in the cooling demand or load, the capacity of compressor 12 is adjusted by regulating the flow rate of the refrigerant through the refrigeration loop. To afford this regulation, a plurality of inlet guide vanes 20, also referred to as pre-rotation vanes ("PRV"), are incorporated in a suction duct conveying vaporized refrigerant from evaporator 18 to compressor 12.

In the disclosed embodiment of the present invention, centrifugal compressor 12 is driven by a prime mover such as an internal combustion engine fueled by natural gas. However, an electrical motor or stem turbine may be used as compressor prime movers in producing the present invention. Natural gas-fueled engine 22 is controlled by a governor 28 included in an engine control panel 30.

Surge in a chiller system results from rapid changes in the chilled water temperatures or other major system disturbances such as, for example, a reduction in the condenser cooling water flow or a rise in condenser water temperature. Repeated surging unduly stresses engine 22 due to wide ranging variations of compressor loading on its output shaft 32. Therefore, a surge detection system (not shown) may be utilized with the present invention. A suitable surge detection system is disclosed in co-pending application serial number 08/630,842, which is assigned to the assignee of the present invention and is incorporated herein by reference. In the surge detection system of the '842 application, surge is constantly monitored, and if three surge events occur within a five minute period, the system is shutdown.

As further shown in FIG. 1, engine 22 is connected to a gearset 34 via a clutch 36. Engine speed may range from 1000 to 1800 RPM; gearset 34 functions in this example to provide a 3600 RPM input drive to compressor 12 at full speed. The engine control panel 30 provides startup and shutdown control and protection for engine 22, clutch 36, and gearset 34, utilizing governor 28 and other control components, such as a programmable logic controller (not shown), a status module (not shown) and an alarm display (not shown). Engine speed is controlled by microprocessor 26 over signal line 38. In response, the governor 28 controls a throttle actuator (not shown) to maintain the engine speed at the desired level.

The capacity control system of the present invention, as shown in FIG. 1, includes a plurality of sensors connected to microprocessor 26 of the chiller control panel 24. One sensor input on line 40 is provided by a pressure transducer 42 as the signal indicative of the absolute pressure $P_c$ in condenser 14. Another sensor input signal on line 43 is obtained from a pressure transducer 44 indicative of the absolute pressure $P_E$ in evaporator 18. The pressure transducers 42, 44 may be pressure-to-current-type or pressure-to-frequency-type transducers, but are preferably pressure-to-voltage-type transducers. The transducers 42, 44 preferably are located at the compressor 12 discharge port and the compressor 12 suction port, respectively, or, alternatively, respectively located in the discharge and suction lines of the compressor 12. In either event, the transducers 42, 44 will sense pressures representative of the discharge and suction pressures of compressor 12.

A third microprocessor input signal on line 46 indicates the inlet guide vane-position of PRV 20. The third input signal is provided by a feedback potentiometer 48 with its movable arm or wiper mechanically coupled to the linkage of a PRV motor (not shown).

A fourth input signal on line 50 is obtained from a thermistor 52 positioned to sense the temperature of the chilled water discharged from the evaporator 18, i.e., the leaving chilled water temperature ("LCHWT").

A fifth input signal on line 54 is an RPM signal provided by a conventional tachometer 56 indicating the actual output speed of engine 22.

A sixth input signal on line 58 is provided by a third pressure transducer 60 positioned to indicate the intake manifold pressure of engine 22. Intake manifold pressure is indicative of engine load and is monitored on a continuous basis.

Figure 2:
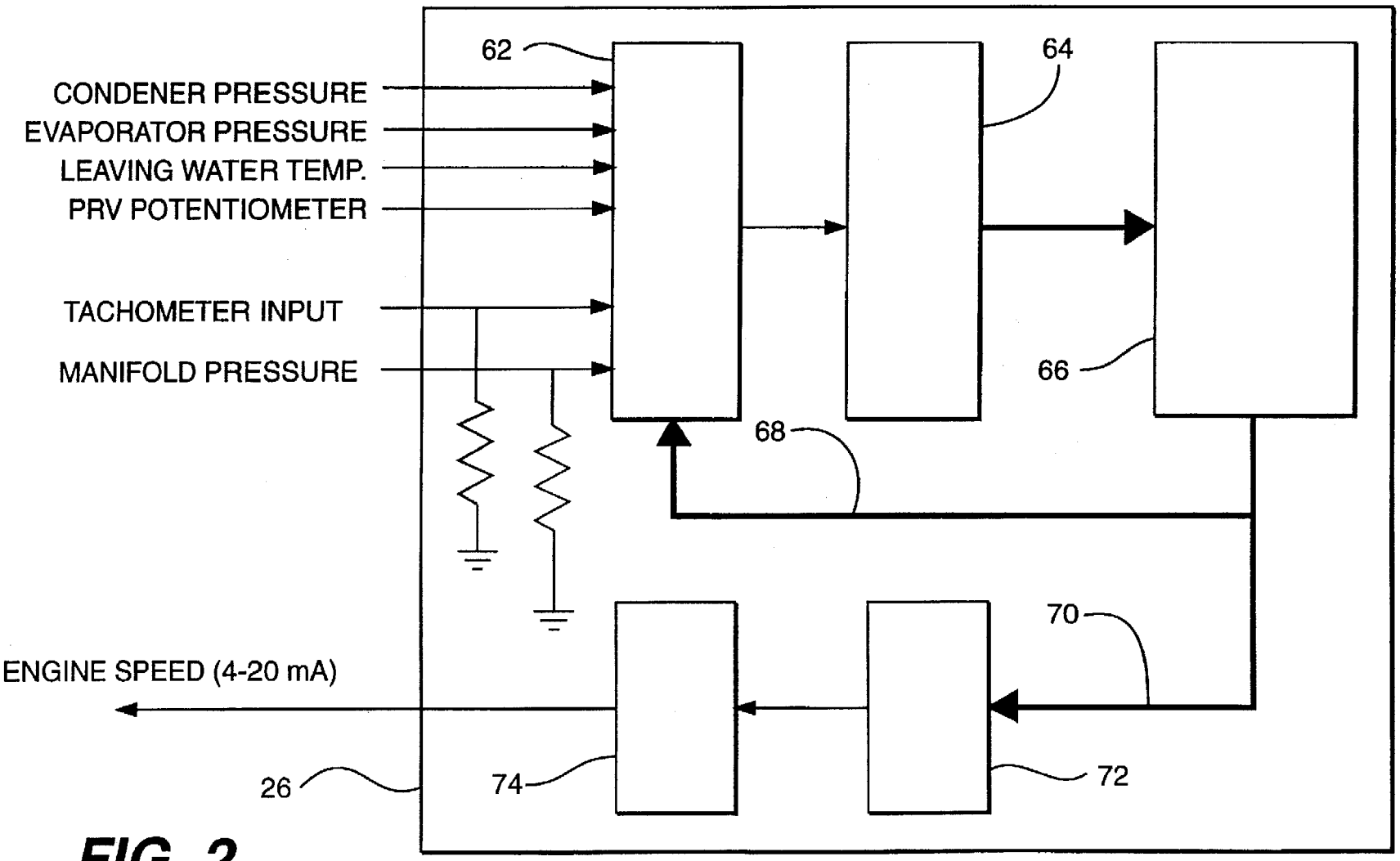
FIG. 2 is detailed block diagram of a microprocessor utilized in the chiller control panel shown in FIG. 1.

In the disclosed embodiment, the first through sixth input signals are analog signals input to a multiplexor 62 included in the microprocessor board 26 of the chiller control panel 24, as shown in FIG. 2. The microprocessor board further includes, as also seen in FIG. 2, an analog to digital converter 64 (A to D converter), which converts the analog multiplexor input signals to digital signals for processing by a microprocessor 66. Polling of the sensor inputs by multiplexor 62 is controlled by microprocessor 66 via a control signal provided on line 68. The microprocessor 66 utilizes the input signals to derive a digital engine speed control signal, the derivation of which will be described below. The digital engine speed control signal is provided on line 70 to a digital to analog converter 72 (D to A converter), where it is converted to an analog engine speed control signal and outputted to voltage to current converter 74. The voltage to current converter 74 transforms the analog engine speed control signal to a current engine speed output signal. The engine speed output current signal is preferably in the range of 4 to 20 mA and controls engine speed, in the disclosed embodiment, over a range of 1000 to 1800 RPM.

The operation of the microprocessor 66 in the chiller control panel 24 will now be described. All processing associated with the capacity control system of the present invention is performed in the microprocessor 66. The chiller control panel 24 is a microprocessor-based control which contains various inputs and outputs for monitoring and controlling the various stages of the chiller system.

The engine load control routine will be described first. As shown above, engine load, which is indicated by the intake manifold pressure measured by transducer 60, is inputted to the microprocessor 66. The engine 22 cylinder pressure at the end of the intake stroke is proportional to the power produced by the engine 22. The cylinder pressure is a function of the intake manifold pressure at any engine speed. Thus, the intake manifold pressure can be used to determine engine load. If the engine load increases to 98% of its rated load, (as pre-programmed into the microprocessor 66) at a given speed measured by the tachometer 56, the microprocessor 66 generates a control signal to increase the engine speed until the engine load falls to 93% of its rated load. The engine load control routine prevents the engine 22 from overloading and ensures that the centrifugal compressor 12 and engine 22 operate as near as possible to peak efficiency by minimizing the compressor impeller (not shown) and engine speeds. If the engine load rises to 98% of its rated load, the PRVs 20 are prevented from further opening. If the engine load rises to 102% of its rated load, then the PRVs 20 will be closed until 100% loading is detected.

Next the initial startup control routine will be described. After a PRV control routine is performed, as for example, in the manner disclosed in the U.S. Pat. No. 4,151,725, assigned to the assignee of the present invention (disclosure incorporated herein by reference) has stabilized the LCI-BVT to within a half of a degree of a setpoint, the engine speed, as indicated by the tachometer 56, is lowered at a rate based on its distance from the optimal engine speed. The LCHWT setpoint, to which the LCHWT is controlled, may be in the range from 38 to 70 degrees Fahrenheit, and is preferably 44 degrees Fahrenheit. As the engine speed is decreased, the PRV's 20 are automatically opened to compensate for the reduced impeller speed, which is directly related to engine speed, since the engine output shaft 32 is rotatably connected to the compressor impeller via speed increaser 34 gears, compressor gears and various couplings.

If the error between the LCHWT and the desired setpoint temperature becomes greater than half a degree, engine speed reduction is inhibited until the PRVs 20 compensate by reducing the error to within the half degree deadband. In this fashion, the PRVs 20 automatically move to their most open position while maintaining the required LCHWT. This initial startup control routine is performed by the microprocessor 66 and further includes prelubing the engine speed increaser 34 and cranking the engine 22 until it is running at 400 RPMs. The routine further includes idling the engine 22 until its coolant temperature rises to 120 degrees Fahrenheit, prelubing the compressor 12, and engaging the engine clutch 36. Upon completion of the initial startup routine, the chiller unit is ready to begin chilling water.

Optimal engine speed, i.e., the speed at which the compressor 12 is as close as possible to surge [hereinafter referred to as "surface speed"], is calculated using a three dimensional equation stored in the microprocessor 66. This three dimensional equation is a linearized representation of the centrifugal compressor surge surface. By operating the compressor 12 near this surge surface, maximum compressor efficiency is obtained. The three dimensional equation uses the compression ratio, $(P_C-P_E)/P_E$, and the PRV position 20, as inputted from the PRV potentiometer 48, as its independent variables. The equation also takes into account dependent variables, such as the diameter of the impeller as determined by the nominal CFM and head design for the compressor 12, the engine to impeller shaft speed ratios, and a safety margin to avoid surge, which are all pre-programmed into the microprocessor 66. The impeller diameter for this embodiment may vary from 10 to 20 inches. The surface speed can be calculated from the following equations and in the following order:

| | | |
|---|---|---|
| (1) | $dp/p = (P_C - P_E)/P_E = P_C/P_E - 1$ | |
| (2) | mach_no_wov = 0.9 | if $dp/p \leqq 0.5$ |
| | mach_no_wov = 0.3*dp/p + 0.75 | if $0.5 \leqq dp/p \leqq 1$ |
| | mach_no_wov = 0.4*dp/p + 0,65 | if $1 \leqq dp/p \leqq 1.5$ |
| | mach_no_wov = 0.23*dp/p + 0.9 | if $1.5 \leqq dp/p \leqq 3$ |
| | mach_no_wov = 1.6 | if $3 \leqq dp/p$ |
| (3) | mach_no = 0.002*(100 − prv) | if 60% < prv ≦ 100% |
| | mach_no = 0.00375*(60 − prv) + 0.08 | if 20% < prv ≦ 60% |
| | mach_no = 0.025*(20 − prv) + 0.23 | if prv ≦ 20% |
| (4) | mach_no = mach_no + mach_no_wov | |
| (5) | mach_no = 1. 6 | if mach_no > 1.6 |
| (6) | surface_sp = | |

(mach_no*acoustic_vel*60)/(impeller_dia*speed_ratio*compr_ratio*π)

Where, mach_no_wov is the wide open PRV 20 position speed increment requirement, mach_no is the partially open PRV 20 position speed increment requirement, impeller_dia is the impeller diameter, speed_ratio is the engine to compressor input shaft speed ratio, compr_ratio is the compressor gear ratio, acoustic_vel is the acoustic velocity, and prv is the measured PRV position. The impeller diameter, engine to input shaft speed ratio and compressor gear ratio are different for each type of engine compressor combination and are preferably entered, via a keypad, into the microprocessor 66. The acoustic velocity, taken from a lookup table, is a function of the evaporator pressure $P_E$ stored in the microprocessor 66. The safety margin, the programmable safety margin to avoid surge, ranges from −75 RPM to +75 RPM, and is preferably 25 to 30 RPM.

When the engine speed, as measured by tachometer 56, comes within 5 RPM of the surface speed, the fuzzy logic algorithm of the present invention takes control. The fuzzy logic algorithm drives the speed error, which is the difference between the engine speed and the surface speed, to zero so that the system can run at its most efficient operating point quickly and easily. The PRV control of the LCHWT is independent of the fuzzy logic speed control until the PRVs 20 are opened to at least 98% of their wide-open vane position. If the LCHWT is greater than LCHWT setpoint, the fuzzy logic algorithm is bypassed, and the engine speed is raised slowly until the setpoint is reached. The fuzzy logic control is also independent of the surge detection apparatus of co-pending application Ser. No. 08/630,842, the initial startup control routine, and the engine load monitoring routine, and thus, may also be bypassed by these routines.

The fuzzy logic algorithm controls engine speed by periodically sampling the actual engine speed from the tachometer 56 at pre-programmed intervals. The programmable intervals may range from 1 to 10 seconds, but preferably ranges from 2 to 5 seconds. The ultimate goal of the fuzzy logic algorithm is to make the speed error approach zero as quickly and as smoothly as possible so that the engine speed is equal to the surface speed. During each sample interval, the fuzzy logic algorithm of the microprocessor 66 determines the degree of membership associated with each input by assigning a weight between zero and one hundred to each input. Then, the fuzzy logic algorithm evaluates several "if then" rules that combine the degrees of membership into the appropriate course of action to be taken by the control system.

Figure 3A:
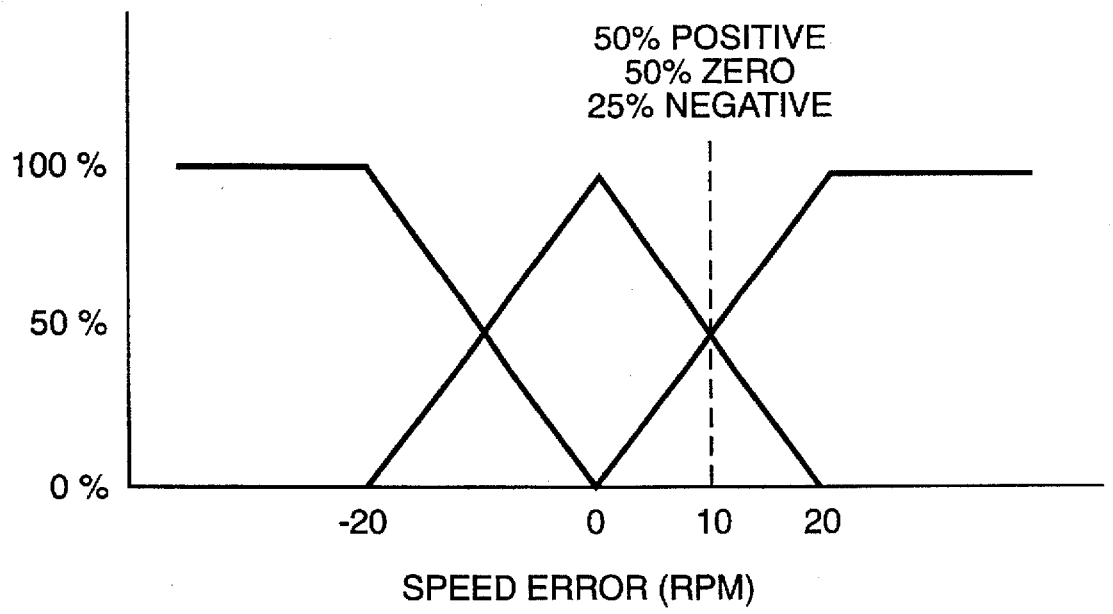
FIG. 3(*a*) is a graph showing the fuzzy logic algorithm membership function for the speed error input.
Figure 3B:
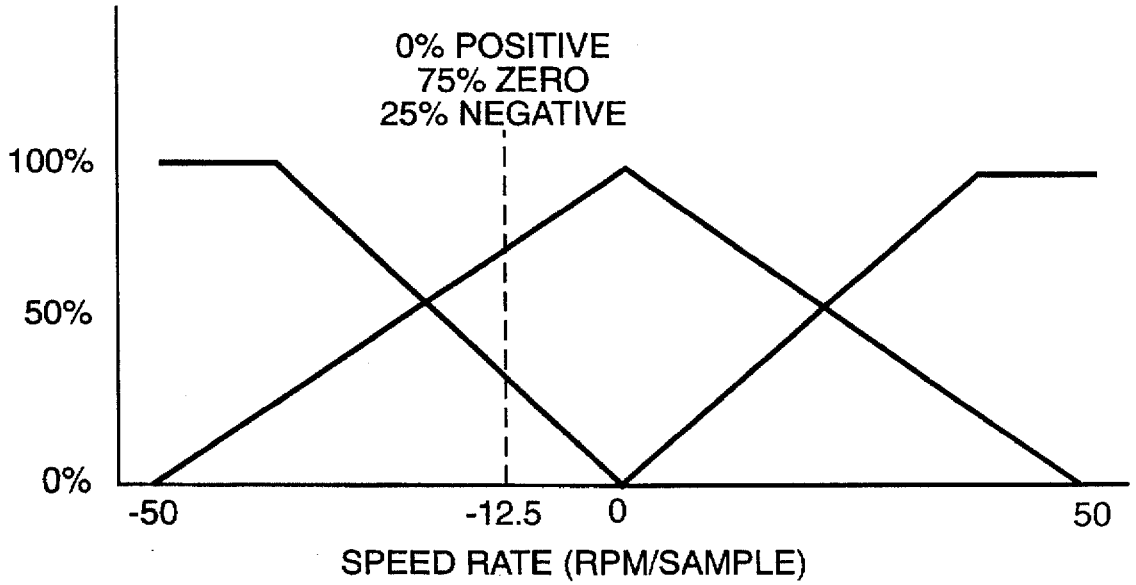
Figure 4A:
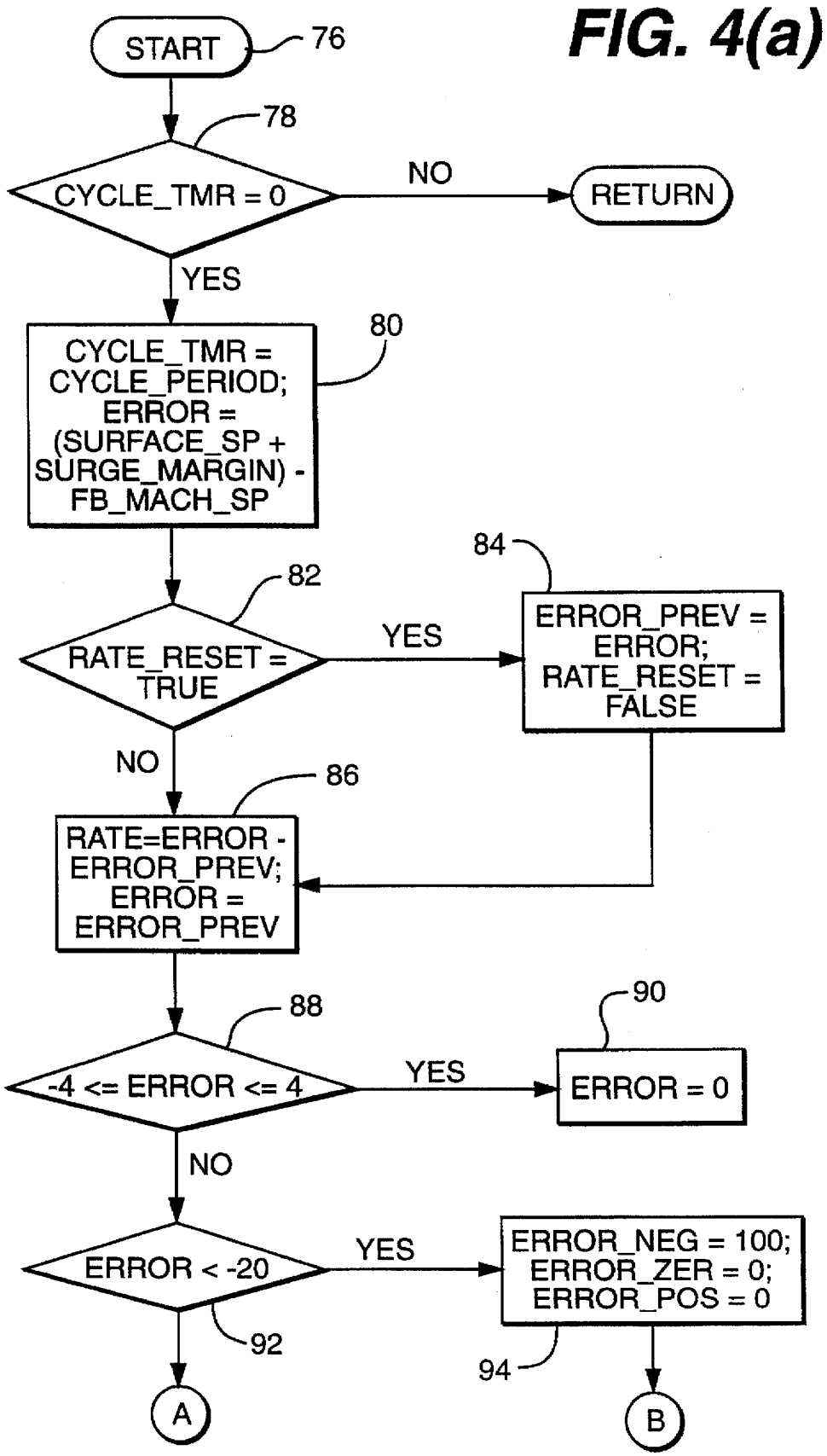
FIGS. 4(*a*)–(*e*) are flow charts illustrating operations performed by the microprocessor of FIGS. 1 and 2 in accordance with an embodiment of the present invention.
Figure 4B:
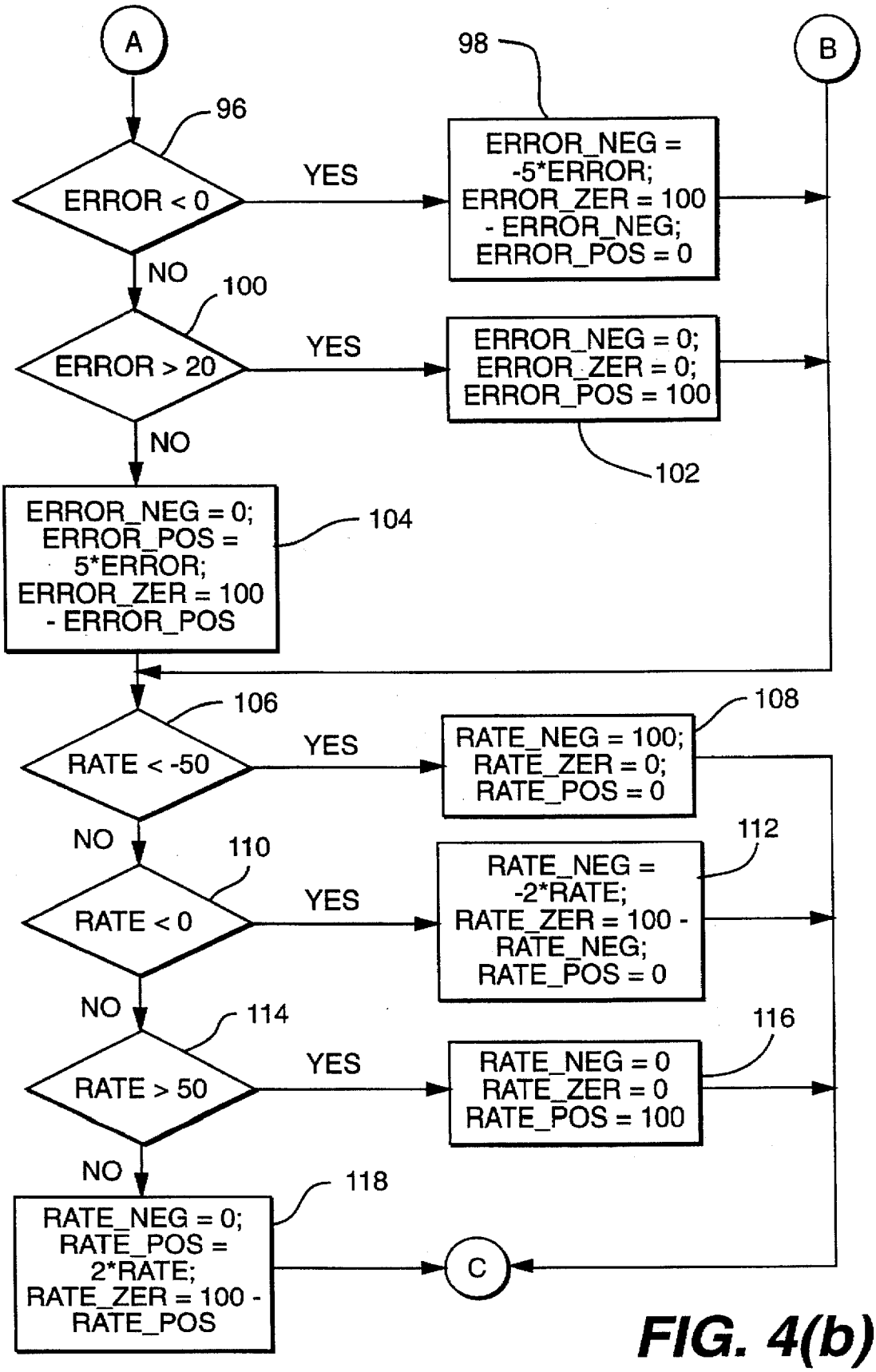
Figure 4C:
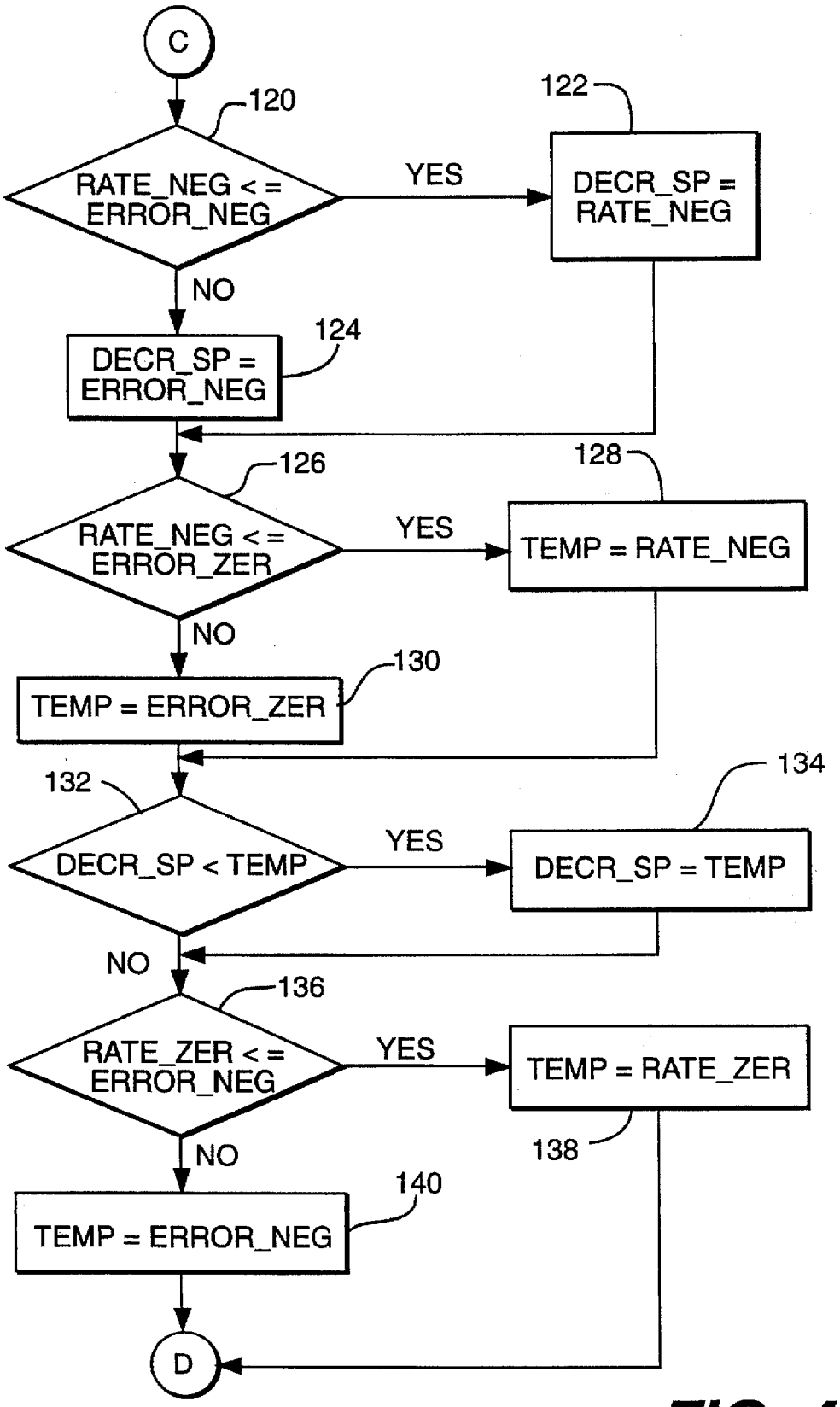
Figure 4D:
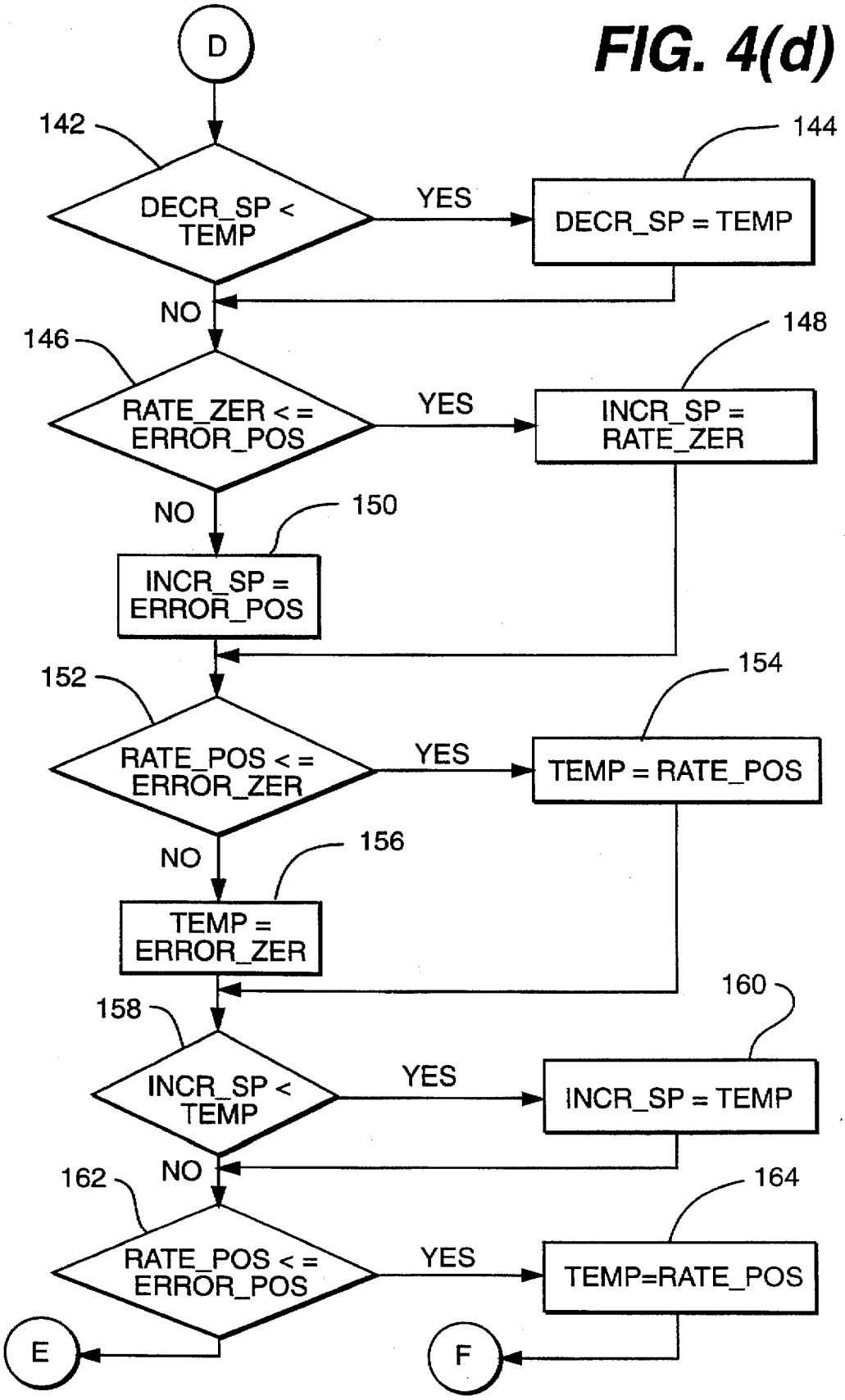
Figure 4E:
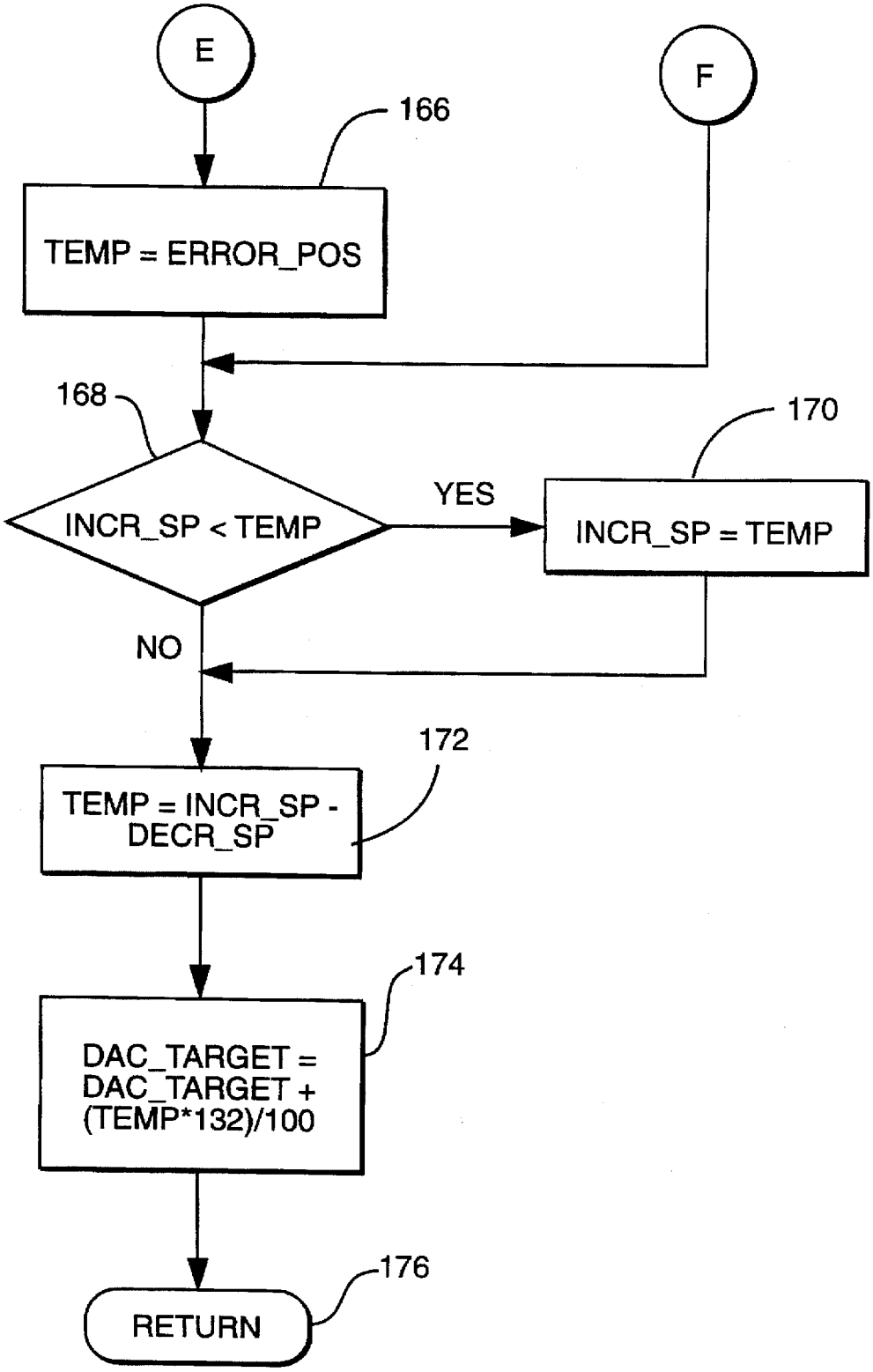

The fuzzy logic algorithm utilizes as inputs both the speed error $\epsilon$ and a speed error rate $d\epsilon$, which is equal to the present measured speed error less the previous time period speed error, as seen in FIGS. 3(*a*) and 3(*b*). To determine whether the engine speed output signal to the governor 28 is to be increased or decreased, three membership functions are defined for each of the two inputs. Each membership function determines in a linear fashion the degree to which the given input is zero, positive or negative. For example, as seen in FIG. 3(*a*), a speed error equal to 10 RPM yields a membership of 50% positive, 50% zero, and 0% negative. Similarly, as shown in FIG. 3(*b*), a speed error rate equal to −12.5 RPM per sample yields a membership function of 25% negative, 75% zero and 0% positive. The membership functions shown in FIGS. 3(*a*) and 3(*b*) are symmetric about zero and reflect the same degree of membership for negative values as positive values when considering inputs of equal magnitude.

Each membership function may be programmably changed in the microprocessor 66 by adjusting the fixed values shown in FIG. 3(*a*) (+/−20 for the speed error $\epsilon$) and in FIG. 3(*b*) (+/−50 for the speed error rate $d\epsilon$). Thus, the sensitivity of both the speed error $\epsilon$ and the speed error rate $d\epsilon$ may be modified as desired to optimize the system control, with lower values yielding higher sensitivity and higher values yielding lower sensitivity. Preferably, the fixed values for the speed error are +/−20 and the speed error rate are +/−50, but the fixed values for either may vary from +/−10 to +/−50.

As shown in the table, $\epsilon_N$, $\epsilon_Z$, and $\epsilon_P$ represent negative, zero, and positive speed errors, respectively, and $d\epsilon_N$, $d\epsilon_Z$, and $d\epsilon_P$ represent negative, zero, and positive speed error rates, respectively. The rule combinations, ($\epsilon_N$, $d\epsilon_N$), ($\epsilon_Z$, $d\epsilon_N$), and ($\epsilon_N$, $d_{\epsilon Z}$), contribute to decrease the engine speed, whereas rule combinations, ($\epsilon_P$, $d\epsilon_Z$), ($\epsilon_P$, $d\epsilon_P$), and ($\epsilon_Z$, $d\epsilon_P$), contribute to increase engine speed. The remaining three rule combinations are not evaluated since they result in no action. Therefore, a total of six rule combinations are evaluated utilizing a fuzzy inference minimum/maximum method. This method implies that a minimum "fuzzy AND" inferencing will be performed first for each of the six rule combinations. Then a "fuzzy OR" inferencing will be performed in which the maximum value is found for the three rule combinations that result in engine speed decrease, as well as for the three rule combinations that result in increased engine speed, thus resulting in two maximum values.

The resulting two maximum values need to be combined into a single output decision, i.e., they need to be "de-fuzzified". Since the centroid method of de-fuzzification is more computationally intensive than required for this application, the singleton approach is preferably used. In the singleton approach, a single output decision is found by subtracting the decrease maximum value from the increase maximum value. If the resultant value is greater than zero, then the D to A converter 72 output value will be increased by the percentage of the resultant value times the maximum allowable value, which is preferably 20 RPM or 132 D to A counts, and may be fixed or programmable. If the resultant value is less than zero, the D to A converter 72 output would be decreased in an equivalent fashion as described for the positive value. The resultant value computed can be anywhere in the range of −100 (maximum D to A converter 72 decrease) to 100 (maximum D to A converter 72 increase). The D to A converter 72 is preferably a 12 bit or $2^{12}$ (4,095) count converter, with one count being equal to 0.152 engine RPMs (20 RPM/132 counts).

The fuzzy inferencing of the present invention will be further clarified by the following example, which is intended to be purely exemplary of the invention, and is seen by the following truth table:

| TRUTH TABLE EXAMLE | $\epsilon_N = 0$ | $\epsilon_Z = 50$ | $\epsilon_P = 50$ |
|---|---|---|---|
| $d\epsilon_N = 25$ | $d_2 = MIN(0, 25) = 0$ | $d_1 = MIN(50, 25) = 25$ | X(no action) |
| $d\epsilon_E = 75$ | $d_3 = MIN(0, 75) = 0$ | X(no action) | $i_1 = MIN(50, 75) = 50$ |
| $d\epsilon_P = 0$ | X(no action) | $i_3 = MIN(50, 0) = 0$ | $i_2 = MIN(50, 0) = 0$ |

The table below shows a fuzzy logic truth table which diagrams how the microprocessor 66 evaluates the fuzzy logic rules in the present invention:

| TRUTH TABLE | $\epsilon_N$ | $\epsilon_Z$ | $\epsilon_P$ |
|---|---|---|---|
| $d\epsilon_N$ | $d_2$(decrease) | $d_1$(decrease) | X(no action) |
| $d\epsilon_Z$ | $d_3$(decrease) | X(no action) | $i_1$(increase) |
| $d\epsilon_P$ | X(no action) | $i_3$(increase) | $i_2$(increase) |

As can be seen in this table, the degree of membership assigned to $\epsilon_Z(50)$ is combined with the degree of membership assigned to $d\epsilon_N(25)$ by performing a minimum fuzzy inferencing, i.e., a fuzzy AND routine. The fuzzy AND routine results in a minimum value of 25 being assigned to a first decrease contribution $d_1$. The same fuzzy AND routine is applied to second and third decrease contributions $d_2$ and $d_3$, to obtain the value of 0 for each, as well as to obtain the values for the first, second and third increase contributions $i_1$, $i_2$, and $i_3$. After the minimum fuzzy inferencing, a maximum fuzzy inferencing is performed, i.e., a fuzzy OR routine is applied to $d_1$, $d_2$, and $d_3$, or a MAX(25, 0, 0), which yields a maximum value of 25 being assigned as the D to A converter decrease contribution d. The same maximum fuzzy inferencing is applied to increase terms $i_1$, $i_2$, and $i_3$, or a MAX(50, 0, 0), which yields a maximum value of 50 being assigned as the D to A converter increase contribution i.

The next step of the fuzzy logic routine is to combine or "de-fuzzify" the resultant D to A converter decrease and increase contributions d and i so that there is a single output decision. The centroid method of de-fuzzification, which is well-known in the art of fuzzy logic, may be used to achieve a single output. However, since the centroid method is more computationally intensive than required for the present application, the singleton approach is preferably used. As well-known in the fuzzy logic art, the singleton approach subtracts the resultant D to A converter decrease contribution d from the resultant D to A converter increase contribution i, which yields the value of 25. Since this value is positive, the D to A converter output value will be increased by 25% of the fixed or programmable maximum allowable value. In the present invention, as shown above, the maximum allowable value of the D to A converter 72 is preferably 132D to A converter counts (a count being defined as 0.152 engine RPMs) or approximately 20 RPMs. Therefore, 25% of a 20 KPM increase is equal to a 5 RPM increase. If the singleton approach yields a negative value, the D to A converter 72 output will be decreased in an equivalent fashion as described above for the positive value. Thus, the resultant value computed by the singleton approach can be anywhere in the range from −100, or the maximum D to A converter 72 decrease, to 100, or the maximum D to A converter increase.

If any of the other control routines described previously, e.g., the PRV control routine, require the speed of the engine 22 to be raised, the fuzzy logic routine is bypassed until the condition is satisfied. Then, the engine speed is lowered until the speed error is less than or equal to 5 RPM, at which time the fuzzy logic routine once again takes control.

The details of a computing device, such as the microprocessor 66 of the chiller control panel 24, required to perform the functions just described with respect to the operation of the fuzzy logic routine are shown in FIG. 4 in flow chart fashion. The microprocessor 66 receives as input signals the absolute pressures $P_C$, $P_E$ in the condenser 14 and evaporator 18, the PRV 20 position, the leaving chilled water temperature LCHWT, the actual engine speed, and the intake manifold pressure of engine 22.

The fuzzy logic routine begins at start block 76 and proceeds to function block 78 where the cycle timer CYCLE_TMR is checked to see if it is equal to zero. The cycle timer CYCLE_TMR is a counter that counts a cycle period, and once the cycle timer CYCLE_TMR is equal to zero, the fuzzy logic algorithm begins. If CYCLE_TMR has not counted to zero, the fuzzy logic routine is exited. Otherwise CYCLE_TMR is set equal to CYCLE_PERIOD, which is equivalent to the sample interval of 2 to 5 seconds as described above. The speed error ERROR is set equal to the value obtained for the surface speed SURFACE_SP plus a safety margin SURGE_MARGIN and less the actual engine speed FB_MACH_SP (block 80). If the rate reset RATE_RESET is found to be "true" in function block 82, then the previous speed error ERROR_PREV is set equal to the current speed error ERROR, and RATE_RESET is set equal to "false" in block 84.

The rate reset RATE_RESET resets the speed error rate by resetting the previous speed error ERROR_PREV to the current speed error ERROR after the first mn through the routine, since the speed error rate retained from the previous fuzzy logic run may be much different than the present speed error rate. Regardless of whether RATE_RESET is "true" or "false", the current speed rate RATE is set equal to the current speed error ERROR minus the previous speed error ERROR_PREV, and the current speed error ERROR is set equal to the previous speed error ERROR_PREV in block 86.

The routine next enters function block 88 where it is determined whether or not the speed error ERROR is between +/−4 RPMs. If the speed error ERROR is within this range, the speed error ERROR is set equal to zero in block 90, otherwise function block 92 is entered where it is determined whether or not the speed error ERROR is less than −20 RPMs. If the speed error ERROR is less than −20 RPMs, then the negative speed error ($\epsilon_N$) ERROR_NEG is set equal to one hundred, and the zero speed error ($\epsilon_Z$) ERROR_ZER and positive speed error ($\epsilon_P$) ERROR_POS are both set equal to zero in block 94, and subroutine B is entered, otherwise subroutine A is entered.

As shown in FIG. 4(*b*), subroutine A begins by determining whether the speed error ERROR is less than zero, i.e., negative, in function block 96. If the speed error ERROR is negative, speed error ERROR_NEG is set equal to −5 times the speed error ERROR, the zero speed error ERROR_ZER is set equal to one hundred less the negative speed error ERROR_NEG, and the positive speed error ERROR_POS is set equal to zero, in block 98. Subroutine B is then entered. If the speed error ERROR is not less than zero, then function block 100 is entered to determine whether the speed error ERROR is greater than twenty. If so, the negative speed error ERROR_NEG and zero speed error ERROR_ZER are both set equal to zero, and the positive speed error ERROR_POS is set equal to one hundred, in block 102, and subroutine B is entered, otherwise block 104 entered. In block 104, the negative speed error ERROR_NEG is set equal to zero, the positive speed error ERROR_POS is set equal to five times the speed error ERROR, and the zero speed error ERROR_ZER is set equal to one hundred less the positive speed error ERROR_POS.

In subroutine B, if the speed error rate RATE is found to be less than −50 in function block 106, then the negative speed error rate RATE_NEG is set equal to one hundred, and the zero and positive speed error rates RATE_ZER, RATE_POS are both set equal to zero in block 108 and subroutine C is entered, otherwise function block 110 is entered. If the speed error rate RATE is found to be less than zero in function block 110, then the negative speed error rate RATE_NEG is set equal to −2 times the speed error rate RATE, the zero speed error rate RATE_ZER is set equal to one hundred less the negative speed error rate RATE_NEG, and the positive speed error rate is set equal to zero in block 112, and subroutine C is entered, otherwise function block 114 is entered. In function block 114, if the speed error rate RATE is greater than fifty, then the negative and zero speed error rates RATE_NEG, RATE_ZER are set equal to zero, and the positive speed error rate RATE_POS is set equal to one hundred in block 116, and subroutine C is entered, otherwise block 118 is entered. In block 118, the negative speed error rate RATE_NEG is set equal to zero, the positive speed error rate RATE_POS is set equal to twice the speed error rate RATE, and the zero speed error rate RATE_ZER is set equal to one hundred less the positive speed error rate RATE_POS, and subroutine C is entered.

As shown in FIG. 4(*c*), subroutine C represents the minimum fuzzy decrease inferencing technique described above and begins in function block 120. Here it is determined whether the negative speed error rate RATE_NEG is less than or equal to the negative speed error ERROR_NEG. If the negative speed error rate RATE_NEG is less than or equal to the negative speed error ERROR_NEG, then the decrease contribution DECR_SP is set equal to the negative speed error rate RATE_NEG, i.e., the minimum value, in block 122, otherwise the decrease contribution DECR_SP is set equal to the negative speed error ERROR_NEG in block 124. At this point, the decrease contribution DECR_SP is equal to the first decrease contribution $d_1$.

In function block 126, if the negative speed error rate RATE_NEG is less then or equal to the zero speed error ERROR_ZER, then a dummy variable TEMP is set equal to the negative speed error rate RATE_NEG in block 128, otherwise the dummy variable TEMP is set equal to the zero speed error ERROR_ZER in block 130. At this time, the dummy variable TEMP represents the second decrease contribution $d_2$. In function block 132, if the decrease contribution DECR_SP is less than the dummy variable TEMP, then the decrease contribution DECR_SP is made equal to the dummy variable TEMP in block 134. This operation is equivalent to finding the maximum decrease contribution between the first and second decrease contributions $d_1$, $d_2$. In function block 136, if the zero speed error rate RATE_ZER is less than or equal to the negative speed error ERROR_NEG, then the dummy variable TEMP is set equal to the zero speed error rate RATE_ZER in block 138, otherwise the dummy variable is set equal to the negative speed error ERROR_NEG in block 140. Subroutine D is then entered. The dummy variable TEMP now represents the third decrease contribution $d_3$.

As shown in FIG. 4(*d*), subroutine D begins in function block 142 by determining whether the decrease contribution DECR_SP, which represents the maximum decrease contribution between the first and second decrease contributions $d_1$, $d_2$, is less than the dummy variable TEMP, which represents the third decrease contribution $d_3$. If the decrease contribution DECR_SP is less than the dummy variable TEMP, then the decrease contribution DECR_SP is set equal to the dummy variable TEMP in block 144. After this operation, the maximum decrease contribution d has been determined and is stored as DECR_SP.

As further shown in FIG. 4(*d*), beginning at function block 146, the remainder of subroutine D represents the minimum fuzzy increase inferencing technique described above and begins by determining whether the zero speed error rate RATE_ZER is less than or equal to the positive speed error ERROR_POS. If the zero speed error rate RATE_ZER is less than or equal to the positive speed error ERROR_POS, then the increase contribution INCR_SP is set equal to the zero speed error rate RATE_ZER, i.e., the minimum value, in block 148, otherwise the increase contribution INCR_SP is set equal to the positive speed error ERROR_POS in block 150. At this time, the increase contribution INCR_SP is equal to the first increase contribution $i_1$.

In function block 152, if the positive speed error rate RATE_POS is less than or equal to the zero speed error ERROR_ZER, then the dummy variable TEMP is set equal to the positive speed error rate RATE_POS in block 154, otherwise the dummy variable TEMP is set equal to the zero speed error ERROR_ZER in block 156. At this time, the dummy variable TEMP represents the second increase contribution $i_2$. In function block 158, if the increase contribution INCR_SP is less than the dummy variable TEMP, then the increase contribution INCR_SP is made equal to the dummy variable TEMP in block 160. This operation is equivalent to finding the maximum increase contribution between the first and second increase contributions $i_1$, $i_2$. In function block 162, if the positive speed error rate RATE_POS is less than or equal to the positive speed error ERROR_POS, then the dummy variable TEMP is set equal to the positive speed error rate RATE_POS in block 164 and subroutine F is entered, otherwise subroutine E is entered.

As shown in FIG. 4(*e*), subroutine F is the same as subroutine E except that it bypasses block 166. In block 166, the dummy variable TEMP is set equal to the positive speed error ERROR_POS. The dummy variable TEMP now represents the third increase contribution $i_3$. As further shown in FIG. 4(*e*), function block 168 determines whether the increase contribution INCR_SP, which represents the maximum increase contribution between the first and second increase contributions $i_1$, $i_2$, is less than the dummy variable TEMP, which now represents the third increase contribution $i_3$. If so, then the increase contribution INCR_SP is set equal to the dummy variable TEMP in block 170. After this operation, the maximum increase contribution i has been determined and is stored as INCR_SP in the microprocessor 66.

Subroutine E continues at block 172, where the dummy variable TEMP is set equal to the difference between the maximum increase contribution INCR_SP and the maximum decrease contribution DECR_SP. This operation is equivalent to the singleton approach of defuzzification discussed above. Then, in block 174, the D to A converter contribution DAC_TARGET is set equal to the previously stored D to A converter contribution DAC_TARGET plus the quantity (TEMP*132)/100. The routine is then restarted at block 176.

The D to A converter 72 is provided with the D to A converter contribution signal DAC_TARGET, which is subsequently converted to an engine speed signal in current form, in the voltage to current converter 74, and is supplied to the governor 28 in the engine control panel 30. The governor 28 converts the engine speed signal to a throttle control signal for controlling the speed of engine 22 to equal the surface speed as quickly and smoothly as possible.

As can be seen from the foregoing disclosure, the present invention utilizes a variety of chiller inputs processed by a fuzzy logic control algorithm in order to quickly and easily drive the speed error of the engine to zero. Thus, the engine and the chiller system can be controlled to operate at the most efficient operating point with a good response time compared to prior art capacity control systems.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A capacity control system for a refrigeration system including a compressor, a condenser, and an evaporator all connected in a closed refrigeration circuit, the compressor having a plurality of adjustable inlet guide vanes and a prime mover connected to drive the compressor, said control system comprising:

a first transducer for sensing condenser pressure to generate a first signal;

a second transducer for serving evaporator pressure to generate a second signal;

a third transducer for sensing the position of the inlet guide vanes to generate a third signal;

a fourth transducer for sensing the actual speed of the prime mover to generate a fourth signal;

a fifth transducer for sensing the temperature of chilled water discharged from the evaporator to generate a fifth signal;

a sixth transducer for sensing the load of the prime mover to generate a sixth signal; and a microprocessor responsive to said first through sixth signals for continuously calculating a surface speed of the prime mover, and for controlling the actual speed of the prime mover to equal the calculated prime mover surface speed utilizing a fuzzy logic algorithm, wherein the prime mover comprises one of an internal combustion engine, an electric motor, and a steam turbine.

2. The capacity control system according to claim 1, wherein said microprocessor calculates the surface speed by utilizing a compression ratio of the prime mover, and the first through third signals.

3. The capacity control system according to claim 2, wherein the fuzzy logic algorithm enables said microprocessor to control when the actual speed of the prime mover is within a predetermined number of RPMs of the surface speed.

4. The capacity control system according to claim 3, wherein the microprocessor uses the fuzzy logic algorithm to continuously calculate the difference between the actual speed of the prime mover and the surface speed to derive a speed error, and drives the speed error to zero.

5. The capacity control system according to claim 4, wherein using the fuzzy logic algorithm, the microprocessor calculates an input speed error rate by subtracting the speed error of a past calculation from a currently calculated speed error and derives plural membership functions for each of the past and current speed error calculations and a calculated speed error rate to determine whether the prime mover speed is to be increased or decreased using the membership functions.

6. The capacity control system according to claim 5, wherein the microprocessor, using the fuzzy logic algorithm, determines the degree of membership associated with each of the speed error and the speed error rate calculations by assigning a weight between zero and one hundred to each calculation, the membership functions resulting in plural prime mover speed decease contributions and plural prime mover speed increase contributions.

7. The capacity control system according to claim 6, wherein the microprocessor, using the fuzzy logic algorithm, performs a minimum fuzzy AND inferencing for the membership functions, performs a fuzzy OR inferencing to calculate a first maximum value for the membership functions that result in prime mover speed increase contributions and a second maximum value for the membership functions that result in prime mover speed decrease contributions, and subtracts the first maximum value from the second maximum value to derive a single prime mover speed control signal.

8. A method for controlling the capacity of a refrigeration system having a compressor, a condenser, and an evaporator all connected in a closed refrigeration circuit, the compressor having a plurality of adjustable inlet guide vanes and a prime mover connected to drive the compressor, wherein the prime mover is any one of an internal combustion engine, an electric motor and a steam turbine, said method comprising the steps of:

generating a first signal representative of the condenser pressure;

generating a second signal representative of the evaporator pressure;

generating a third signal representative of the inlet guide vane position;

generating a fourth signal representative of the prime mover speed;

generating a fifth signal representative of the temperature of chilled water discharged from the evaporator;

generating a sixth signal representative of the load of the prime mover;

generating control signals in response to said first through sixth signals to continuously calculate a surface speed of the prime mover; and controlling prime mover speed to the calculated surface speed utilizing a fuzzy logic algorithm.

9. The method for controlling the capacity of a refrigeration system according to claim 8, wherein the generating step comprises calculating the surface speed by utilizing a compression ratio of the prime mover, and said first through third signals.

10. The method for controlling the capacity of a refrigeration system according to claim 9, wherein the controlling step utilizes the fuzzy logic algorithm to control prime mover speed when within a predetermined number of RPMs of the surface speed.

11. The method for controlling the capacity of a refrigeration system according to claim 10, wherein the controlling step utilizes the fuzzy logic algorithm to continuously calculate a difference between actual speed of the prime mover and the surface speed to derive a speed error, and drives the speed error to zero.

12. The method for controlling the capacity of a refrigeration system according to claim 11, wherein the controlling step utilizes the fuzzy logic algorithm to calculate an input speed error rate by subtracting a calculated past speed error from a calculated current speed error, derives plural membership functions for each of the calculated past and current speed error rates, and determines whether the speed of the prime mover is to be increased or decreased using the membership functions.

13. The method for controlling the capacity of a refrigeration system according to claim 12, wherein the controlling step includes the step of using fuzzy logic algorithm to determine a degree of membership associated with each of the calculated speed error and the calculated speed error rate by assigning a weight between zero and one hundred to the calculated speed error and speed error rate, and the plural membership functions providing multiple prime mover speed decease contributions and multiple prime mover speed increase contributions.

14. The method for controlling the capacity of a refrigeration system according to claim 13, wherein the controlling step includes the step of using the fuzzy logic algorithm to perform a minimum fuzzy AND inferencing for the membership functions, to perform a fuzzy OR inferencing to calculate a first maximum value for the membership functions providing the prime mover speed increase contributions and a second maximum value for the membership functions providing the prime mover speed decrease contributions, and to subtract the first maximum value from the second maximum value to derive a single prime mover speed control signal.

* * * * *